US006177883B1

(12) United States Patent
Jennetti et al.

(10) Patent No.: US 6,177,883 B1
(45) Date of Patent: Jan. 23, 2001

(54) UTILITY METER TRANSPONDER EXPOSED GROUND LEVEL ANTENNA ASSEMBLY

(75) Inventors: Anthony G. Jennetti, Sunnyvale; Richard J. Davis, Cupertino; Steven H. Larson, San Jose; Donald L. Rucker, Santa Crus, all of CA (US); Brent Walden, Montgomery, AL (US); Ivan P. DaSilva, Hillsborough, NJ (US)

(73) Assignee: Schlumberger Resource Management Services, Inc., Norcross, GA (US)

( * ) Notice: Under 35 U.S.C. 154(b), the term of this patent shall be extended for 0 days.

(21) Appl. No.: 09/145,940

(22) Filed: Sep. 2, 1998

(51) Int. Cl.[7] ..... G08B 23/00

(52) U.S. Cl. ..... 340/870.02; 343/719; 343/720; 343/872

(58) Field of Search ..... 340/870.02; 343/719, 343/720, 872

(56) References Cited

U.S. PATENT DOCUMENTS 5,877,703 * 3/1999 Bloss, Jr. et al. ..... 340/870.02

* cited by examiner

*Primary Examiner*—Michael Horabik
*Assistant Examiner*—Timothy Edwards, Jr.
(74) *Attorney, Agent, or Firm*—Dority & Manning, P.A.

(57) ABSTRACT

An arrangement for radio utility meter reading processing of data acquisition for use with an automatic billing system involves a water meter transmitter antenna system installed at or near ground level in an outdoor environment. A radio frequency utility meter communication apparatus transmits utility meter data to a remote utility meter data collection unit from an underground pit box. The pit box receives a utility meter and has a generally ground level pit lid with an opening therethrough. An antenna element has an upper member extending at least partly through the pit lid opening and received thereabove. A depending base of the antenna element extends from the upper element and passes through the pit lid opening into the underground pit box. The antenna element is at least partly exposed to its surrounding environment. An RF transmitter inside the underground pit box is associated with the antenna element depending base so that RF signals output by the RF transmitter are propagated by the antenna element. A utility meter also located within the underground pit box is arranged for outputting its data to the RF transmitter, so that the upper portion of the antenna element at least partly situated above an exterior, above ground portion of the pit box lid, propagates utility meter data from the utility meter within the pit box to a remote utility meter data collection unit.

20 Claims, 2 Drawing Sheets

UTILITY METER TRANSPONDER EXPOSED GROUND LEVEL ANTENNA ASSEMBLY

BACKGROUND OF THE INVENTION

The present invention relates to radio utility meter reading processing, and is more particularly but not exclusively concerned with a radio transmitter antenna arrangement which is associated with a utility meter, particularly a water meter, for the purpose of transmitting readings of such meter from a generally underground pit box to a remote receiver.

In conventional practice in the area of utility meter reading for data acquisition and automatic billing, a meter which is intended to be remotely read is installed with a radio transmitter. Such radio transmitter produces radio frequency energy that is coupled to an antenna for broadcasting.

Generally, the nature of such arrangements results in the antenna being placed in an outdoor environment, often at ground level, and in close proximity to a variety of materials and varying weather conditions. Nearby materials may include (and may change from time to time, depending on the environment) items such as metal, plastic, concrete, or organic materials. Weather conditions may involve, from time to time, environmental exposure to ice, snow, water, and temperature extremes (both cold and hot).

The amount of radio frequency energy actually irradiated into the airwaves as compared with that intended to be irradiated is a function of a number of factors. Such factors may include the applied voltage, the amount of current flowing through the antenna, the frequency of the signal applied to the antenna, the material from which the antenna is made, the geometry of such antenna, and the materials that are in a relatively close surrounding space of the antenna (such as within a sphere-radius measuring up to a few wavelengths of the radio signal applied to such antenna). When the surroundings of the antenna vary, the antenna performance (ie., the degree of the radiated energy therefrom) will also tend to vary correspondingly. The more that adjacent or nearby materials tend to permeate the environment of a particular antenna, the greater the affects on the antenna and its performance, typically to the detriment of such performance.

As is well known, current flow is a function of applied voltage and the equivalent impedance of the system. The equivalent impedance system for an antenna generally is a function of the efficiency of the antenna itself, of the impedance characteristics of the transmission line which is carrying the radio frequency energy from a transmitter to such antenna, and of the geometry of such antenna that presents a particular impedance at given frequencies of operation.

To achieve desired range and reliability of radio frequency communications from pit box generated data, it would be desirable to maintain a controlled and also uniform radio frequency energy irradiation pattern from the antenna used to transmit a radio signal from an enclosed utility meter. One type of antenna conventionally used for utility meter remote transmitting uses a conventional loop antenna design as the irradiator element. Generally speaking, the proximity to the ground which is required for the arrangement results in a deformation in the irradiation pattern produced by the irradiated signal.

Problems encountered with such non-uniform irradiation patterns are further complicated by the fact that irradiated energy may vary from place to place where the antenna is installed. For example, in some antenna systems there may be multiple transmitters that will be sending data to a receiver system, where the transmitter antenna will be installed in cast iron, plastic, or concrete lids of boxes installed underground and with lids thereof generally flush with ground level. Such boxes are commonly called pit boxes in the utility industry, particularly in the water utility industry.

A number of attempts have been made to provide an antenna system that is capable of operating in particular from a water meter pit box environment. However, complete systems for water meters on occasion have been required to be removed from the field for reasons such as poor antenna function, poor range, inconsistent range, and other related problems that also affect the life and/or durability of the effective water meter reading system using a radio frequency transmitter system for data collection.

A number of factors are subject to consideration in providing any successful integrated antenna system. A few of such conditions or factors may include: frequency of operation, transmitter output power, antenna gain, antenna polarization, antenna pattern, azimuth beam-width, azimuth variation, government regulations for operating radio equipment, characteristic antenna impedance, coefficient of maximum wave reflection, antenna geometry, antenna location, ability to effect installation, length of service life desired, ability to operate in exposed environmental conditions such as exposure to water with only very small variation in operation performance due to any water absorption into the antenna system, ultra-violet resistance, shock and vibration resistance, and environmental temperature variability resistance. At the same time, one must be aware of cost factors and the ability to manufacture a large volume of such units (for use in a full system having a number of meter reading locations) with reliability and repeatability of performance.

Examples of several known antenna arrangements for use with utility meter pit boxes are disclosed in Cerny, et al. (U.S. Pat. No. 5,298,894) and Meek, et al. (U.S. Pat. No. 5,621,419). The complete disclosures of such patents are fully incorporated herein by reference.

SUMMARY OF THE INVENTION

The present invention recognizes and addresses various of the foregoing problems, and others, concerning pit box antenna arrangements. Thus, broadly speaking, a principal object of this invention is improved pit box antenna arrangements. More particularly, a main concern is providing improved antenna arrangements for desired quality of utility meter communications even with the provided antenna elements being at least partly exposed to their surrounding environment.

It is another general object of the present invention to provide improved pit box antenna arrangements which have improved range and reliability while still providing an arrangement which may reside close to the ground, for example, to accommodate mowing.

A more particular object is to provide an improved pit box antenna arrangement which functions in conjunction with a pit lid opening, so as to have an antenna element portion at least partly situated above an exterior, above ground portion of the pit box lid for propagating utility meter data from a utility meter within the pit box to a remote utility meter data collection unit.

It is a further more particular object of the present invention to provide such improved antenna arrangements which are operable generally with a variety of utility meter types, such as gas, electric, and water utility meters. It is an additional such object to provide an improved antenna arrangement which may be used in a variety of settings, in conjunction with various transmitters which might be associated with the output of a given utility meter in a given embodiment of a pit box arrangement.

Additional objects and advantages of the invention are set forth in, or will be apparent to those of ordinary skill in the art from, the detailed description herein. Also, it should be further appreciated that modifications and variations to the specifically illustrated and disclosed features or materials or devices hereof may be practiced in various embodiments and uses of this invention without departing from the spirit and scope thereof, by virtue of present reference thereto. Such variations may include, but are not limited to, substitution of equivalent means and features or materials for those shown or discussed, and the functional or positional reversal of various parts or features or the like.

Still further, it is to be understood that different embodiments, as well as different presently preferred embodiments, of this invention may include various combinations or configurations of presently disclosed features or elements or their equivalents (including combinations of features or configurations thereof not expressly shown in the figures or stated in the detailed description). One exemplary such embodiment of the present invention relates to radio frequency utility meter communication apparatus for transmitting utility meter data to a remote utility meter data collection unit from an underground pit box receiving a utility meter and having a generally ground level pit lid with an opening therethrough.

The foregoing exemplary embodiment of communication apparatus may comprise an antenna element, an RF transmitter, and utility meter interconnection means, all in accordance with the subject invention.

The foregoing exemplary antenna element may have a top cap extending at least partly through the pit lid opening and received thereabove. It may further have a depending base extending from such top cap and passing through the pit lid opening into the underground pit box, such that the antenna element is at least partly exposed to its surrounding environment.

The foregoing exemplary RF transmitter may be situated inside the underground pit box and associated with the antenna element depending base such that RF signals transmitted by such RF transmitter are propagated by the antenna element. The exemplary utility meter interconnection means are provided for interconnecting data from a utility meter within such underground pit box to the RF transmitter also situated therein.

With the foregoing exemplary arrangement, the antenna element top cap, at least partly situated above an exterior, above ground portion of the pit lid box, propagates utility meter data from the utility meter within the pit box to a remote utility meter data collection unit.

Another present exemplary embodiment concerns an arrangement for obtaining data from a water meter received in an underground pit box of the type having a lid with a predetermined opening therethrough. Such arrangement preferably comprises transmitter means combined with antenna means, in accordance with the subject invention.

The foregoing exemplary transmitter means are received within such a pit box and interconnected with a water meter received therein for transmitting water meter data therefrom. The exemplary such antenna means are preferably associated with such transmitter means, and extend at least partly through such pit lid predetermined opening so as to be outside such pit box. With such an arrangement, the water meter data advantageously transmitted by such transmitter means are propagated by the antenna means from a portion thereof outside such pit box.

In the foregoing exemplary arrangement, such antenna means preferably includes an upper generally circular member or top cap passed through and exposed above the predetermined opening of the pit box lid. It may further include a lower generally straight member (or depending base) extending downwardly from such upper member or top cap so as to extend and pass through the pit box lid opening down into the pit box, such that the antenna means are at least partly exposed to its surrounding environment.

Those of ordinary skill in the art will better appreciate the features and aspects of such embodiments, and others, upon review of the remainder of the specification.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

Figure 1:
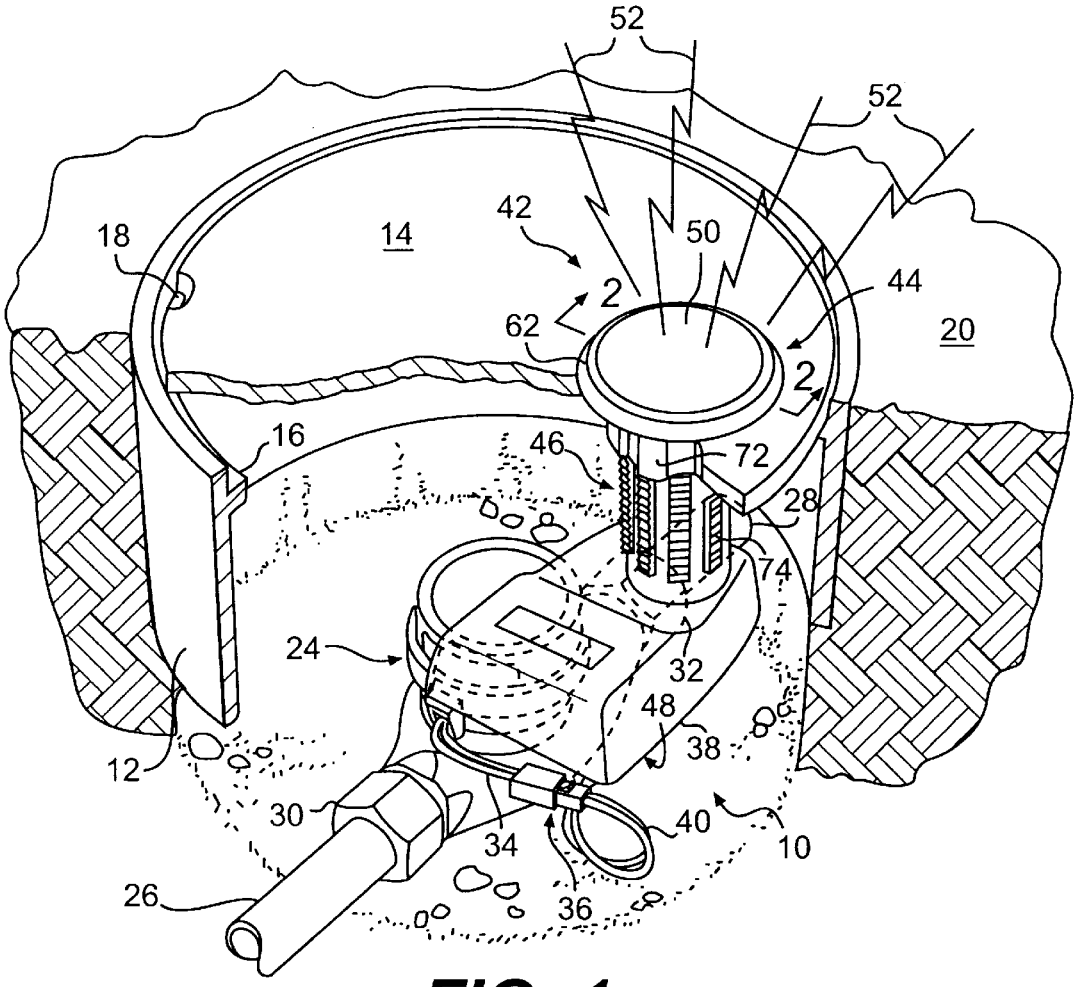
FIG. 1 is a generally perspective view of an exemplary embodiment of the subject invention, shown in partial cutaway of an associated pit box and pit lid and partially in phantom (i.e., transparent) to show use of the exemplary embodiment in its intended environment of an underground pit box and its relationship with the pit lid and pit lid opening thereof.

Repeat use of reference characters throughout the present specification and appended drawings is intended to represent same or analogous features or elements of the invention.

DETAILED DESCRIPTION OF THE PREFERRED EMBODIMENTS

It is to be understood by those of ordinary skill in the art that the following description is intended by way of example only, and is not intended to limit the broader scope of the subject invention. Likewise, the invention may be practiced in different embodiments, including embodiments different from anything specifically shown in the accompanying figures or explicitly suggested in the subject specification. For example, the subject invention may be practiced in conjunction with transmitting data from a variety of utility meters, such as gas or electric meters, though only a water meter representation is presently illustrated.

Figure 2:
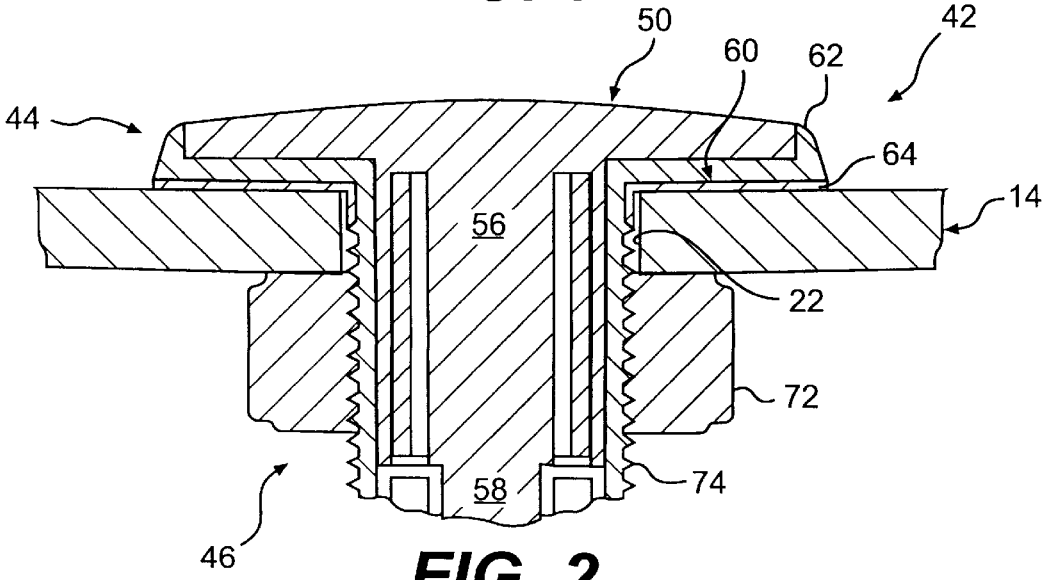
FIG. 2 is an enlarged partial view of the embodiment of present FIG. 1 shown in cross section, taken along the sectional line 2—2 shown in such FIG. 1, and showing in greater detail an exemplary relationship with a pit lid and pit lid opening.
Figure 3:
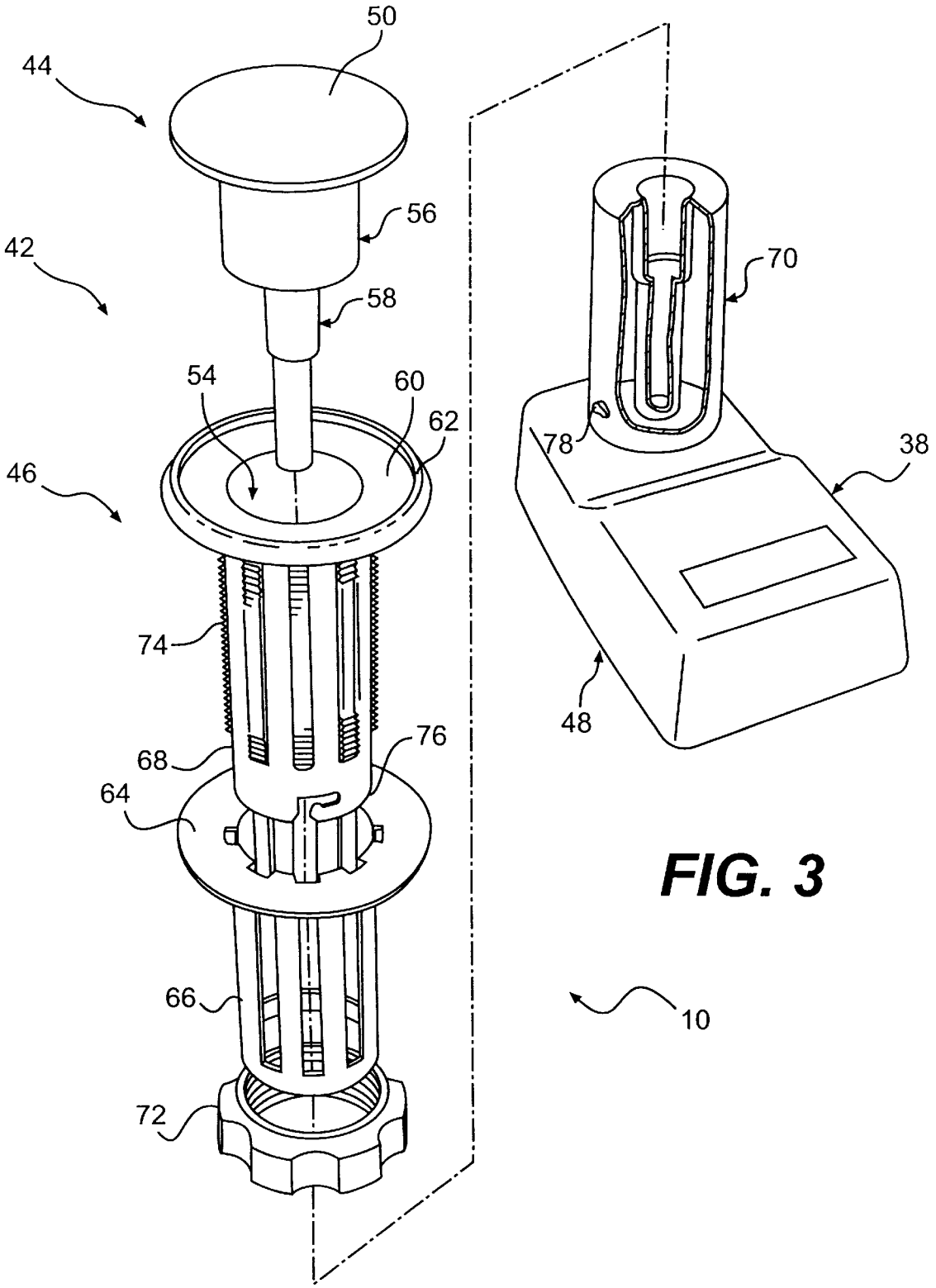
FIG. 3 is an exploded assembly view (with partial cutaway imagery) in isolation of the exemplary embodiment of present FIGS. 1 and 2.

Referring collectively to present FIGS. 1 through 3, an exemplary radio frequency utility meter communication apparatus generally 10 is represented in accordance with the subject invention for use such as with a conventional pit box generally 12 having a removable pit lid generally 14. Such pit box 12 may conventionally comprise various elements such as metal (for example, cast iron), concrete, or plastic. Typically, an internal ledge generally 16 may be provided for support of removable lid 14, with a notch 18 or similar for ease of lid removal.

As represented in the generally perspective view of present FIG. 1 (with partial cutaway illustration of pit box 12 and pit lid 14 and partial phantom illustration of apparatus 10), pit box 12 is primarily underground with its lid 14 generally flush about with upper ground level generally 20. The width or thickness of lid 14 may vary among different installations, but is typically within a thickness range of about 0.5 inches to about 3.0 inches. As referenced in greater detail below, lid 14 is also provided with a generally circular opening 22. The present invention interacts and functions with such opening 22, such as represented in the present isolated and enlarged partial view (in cross section) illustrated by present FIG. 2. The viewpoint of FIG. 2 is taken along the section line 2—2 represented in present FIG. 1.

Returning to present FIG. 1, a representational illustration is provided of a water meter generally 24 residing in-line relative to two sections of water pipe generally 26 and 28. For present purposes, it is not necessary to designate one or the other of such water pipes 26 and 28 as inflow or outflow. It will be well understood by those of ordinary skill in the art that a flow of water will pass in some direction through such pipes 26 and 28 (which may be respectively coupled to water meter 24 with nuts 30 and 32) which flow in turn is measured by water meter 24. Where water meter 24 is replaced by a gas or electric meter, water pipes 26 and 28 are replaced by gas and electric lines, respectively, as understood by those of ordinary skill in the art.

Such water meter 24 is preferably of the type providing meter data for transmission to a remote utility meter data collection unit. Such data may be provided over electrical wires, generally 34, as well understood by those of ordinary skill in the art without requiring additional description.

Utility meter interconnection means generally 36 may be provided for interconnecting data on such lines 34 with an RF transmitter otherwise situated inside such underground pit box 12. In the present exemplary embodiment, such RF transmitter is represented as being enclosed and/or received within a housing body member generally 38 which may be provided for such purpose. The data connection is further realized through additional wires 40. Wires 34 and 40 may comprise shielded wiring or similar.

Those of ordinary skill in the art will appreciate and understand that a variety of utility meter interconnection means may be provided for interconnecting wires 34 and 40. For example, various removable plug arrangements (such as achieved by correspondingly matable male and female plug members) may be provided. Such members may be joined through removable interference fits, or may be joined by other elements (either temporarily or more permanently), such as screws, bayonet mounts, capture nuts, brads, or rivets. All of such variations for providing utility meter interconnection means (whether removable or not) are intended to come within the spirit and scope of the present invention.

The following description references collectively present FIGS. 1 through 3 in greater detail for discussing how RF energy fields produced by RF radio equipment installed with an exemplary utility meter within pit box 12 are relatively directly fed into an antenna arrangement provided in accordance with the subject invention.

FIG. 1 illustrates an overall perspective view of an exemplary arrangement, in relation to the partial cutaway imagery of an exemplary pit box 12 and pit lid 14. FIG. 2 illustrates in greater detail an enlarged and partial view of components of the subject exemplary embodiment of an antenna arrangement cooperating and interacting with pit lid features of a conventional pit box. Such FIG. 2 is taken along a sectional line 2—2 as represented in present FIG. 1. FIG. 3 provides an exploded assembly view (with partial cutaway) of an exemplary embodiment of the subject invention in isolation (i.e., separated from representations of the conventional pit box and pit lid illustrations of present FIG. 1 and the exemplary water meter and water line illustrations also shown in present FIG. 1).

In accordance with this invention, an exemplary radio frequency utility meter communication apparatus generally 10 for transmitting utility meter data to a remote utility meter data collection unit from an underground pit box generally 12 receiving a utility meter generally 24 is positionally and functionally interactive with a generally ground level pit lid 14 with an opening 22 therethrough. Such an exemplary arrangement has an antenna element generally 42 having an upper member generally 44 extending at least partly through the pit lid opening 22 and received thereabove, and having a depending base generally 46 extending from the upper portion 44 and passing through the pit lid opening 22. Such lower portion 46 therefore passes into the underground pit box 12. At least a portion of antenna element generally 42 is therefore in accordance with the subject invention exposed to its surrounding environment.

Further concerning such embodiment of the subject invention, an RF transmitter generally 48 is situated preferably inside the underground pit box 12 and associated with the antenna element generally 42 and its depending base generally 46 such that RF signals transmitted by such RF transmitter 48 are propagated by the antenna element generally 42. Complete details of RF transmitters are completely understood by those of ordinary skill in the art and form no particular aspect of the subject invention. Accordingly, it is sufficient for an adequate disclosure of the present invention to understand and appreciate that such RF transmitter subject matter may be received generally within housing 38 in accordance with the subject invention. Exemplary additional details of exemplary RF transmitters are incorporated by reference in view of the incorporation by reference of above-indicated U.S. Pat. Nos. 5,298,894 and 5,621,419.

Referring more specifically to greater details of present FIGS. 1 through 3 collectively, antenna features in accordance with the present invention may include a top metal portion generally 50 of the present exemplary antenna system. Brass is an exemplary metal of which such element 50 may be comprised, for combined features of durability and effective transmission (i.e., irradiation) as an antenna element. Lines 52 of present FIG. 1 are intended to represent such irradiation.

Element 50 is received and assembled into dielectric material generally 54 and in passing through such dielectric material 54 is associated with at least one of the impedance matching components generally 56 and 58. Generally speaking, the techniques for calculating impedance matching values and providing such components are well known to those of ordinary skill in the art and form no particular aspect of the subject invention, wherefore additional details thereof are not required for a complete understanding of the subject invention.

Top metal portion 50 and further antenna ring element generally 60 may have dimensions (such as respective diameters) that may be calculated as a function of the frequency of operation of the system and the nature of the dielectric material present at element generally 62, which calculations are well known to those of ordinary skill in the art without requiring present additional details. Dielectric material generally 62 is also selected so as to provide relatively low radio signal loss, responsive to a large band of operational frequencies. As is apparent from the present illustrations of FIGS. 1 through 3, such dielectric material 62 is formed also so as to provide mechanical support for the antenna generally to operate in outside environmental conditions.

As further represented, top metal portion generally 50 preferably continues in integral fashion so as to further form the component 56. The antenna ground plane generally 64 is assembled under the dielectric material generally 62 and extends to further depending element generally 66 for completion of matching elements in accordance with the subject invention. The space or separation between the top metal portion generally 60 and the antenna ground plane generally 64 is filled with the dielectric material generally 62. These constitute the irradiator element of the present invention antenna system.

Generally speaking, antenna ground plane 64 in the subject antenna system provides ground reference allowing the subject antenna to be installed even in pit environmental conditions as referenced generally above. In accordance with the exemplary embodiment of the subject invention, top metal portion generally 50, antenna ring generally 60, dielectric material 62, and antenna ground plane generally 64 are the only components that will be placed outside pit box generally 12 whenever the subject antenna system for transmitting water meter data is practiced. In such manner, the antenna element top cap 50 is exposed to the environment outside of underground pit box 12. Optionally, in addition, it may be understood that at least part of antenna depending element generally 46 is exposed to the environment present within underground pit box 12.

The irradiator element or collective components of the subject antenna system (as composed by top metal portion generally 50, antenna ring generally 60, dielectric material 62, and antenna ground plane 64) are designed to have a low profile relatively close to ground upper surface 20 so as to minimize any obstructions. Such a collective irradiator element will preferably operate with a very low impedance characteristic due to the size of the antenna, and due to the close proximity of antenna ring generally 60 relative to the antenna ground plane generally 64. Such conditions provide for desired operation of the subject invention in the context of application to a pit box 12 environment.

As generally referenced above, an RF or radio signal source such as a transmitter generally 48 provides a radio signal to the irradiator element collectively comprised of features 50, 60, 62, and 64 as referenced above. For most typical applications of the subject invention, a standard output impedance for the radio signal source may be established as 50 ohms. As is well known to those of ordinary skill in the art, in order to prevent or lessen radio signal reflection back to its source, it is preferred to have a matching element that provides the impedance transformation from the radio source output impedance to the low impedance irradiator element described herein. A quarter-wavelength matching element is preferably created once components 56 and 58 are inserted into indicated components 54, 62, and 68, and subsequently such collective group of components 56, 58, 62, and 68 are again further inserted into an antenna ground plane extension portion generally 66.

As will be well understood by those of ordinary skill in the art without further specific description, the diameter of component 56, the wall thickness of component 68 and its corresponding dielectric constant, and the dimensions of the antenna ground plane extension 66 are determinative dimensions for obtaining an appropriate and/or desired matching element for the subject antenna system.

Collectively, in essence, the group of components 50, 56, 58, 60, 62, 68, 64, and 66 as discussed above form the pit antenna irradiator with a built-in matching element that presents a same impedance characteristic as that of the radio source element generally 48. As noted above, impedance matching in any antenna system (or other form of transmission system) is a preferred approach to avoid partial reflection of the radio signal (or other signal being transmitted).

The arrangement of the subject invention preferably results in two main groups of components. As discussed above, components 50, 56, 58, 60, 62, 68, 64, and 66 may be all grouped or regarded together as forming the antenna main body or irradiator element. Accordingly, details of such components, as discussed and illustrated specifically in the specification and appended figures, are important aspects of the present invention. Certain other features concerning the manner of provision of, for example, a battery operated RF utility meter data signal are less important in detail relative to the subject invention.

As represented by the present figures, housing generally 38 may be associated with a further housing component or aspect generally 70. Data lines 40 may lead into housing 38, wherein an RF transmitter generally 48 may receive such data and then output RF signals to the above-described antenna features of the subject invention. As represented by the figures collectively, a capture nut generally 72 may cooperate with outward threads generally 74 for securing the subject antenna arrangement relative to pit lid 14. With such an arrangement, a free or distal end generally 76 of depending element 68 may engage a member or portion generally 78 of upright and telescopically-related housing element 70, for securing housing elements 70 and 38 and their corresponding contents to the arrangement otherwise supported on pit lid 14.

Variations and modifications to the subject invention may be practiced without departing from the spirit and scope thereof. Specifically, it should be further understood by those of ordinary skill in the art that the foregoing presently preferred embodiment is exemplary only, and that the attendant description thereof is likewise by way of words of example rather than words of limitation and their use does not preclude inclusion of such modifications, variations, and/or additions to the present invention as would be readily apparent to one of ordinary skill in the art, the scope of the present invention being set forth in the appended claims.

What is claimed is:

1. A radio frequency utility meter communication apparatus for transmitting utility meter data to a remote utility meter data collection unit from an underground pit box receiving a utility meter and having a generally ground level pit lid with an opening therethrough, said communication apparatus comprising:

an antenna element having a top cap extending at least partly through the pit lid opening and received thereabove, and having a depending base extending from said top cap and passing through the pit lid opening into the underground pit box, said antenna element at least partly being exposed to its surrounding environment;

an RF transmitter situated inside the underground pit box and associated with said antenna element depending base such that RF signals transmitted by said RF transmitter are propagated by said antenna element;

utility meter interconnection means for interconnecting data from a utility meter within an underground pit box to said RF transmitter situated inside such underground pit box;

whereby said antenna element top cap, at least partly situated above an exterior, above ground portion of the pit box lid, propagates utility meter data from the utility meter within the pit box to a remote utility meter data collection unit.

2. An apparatus as in claim 1, wherein said utility meter interconnection means are interconnected with a water meter within the underground pit box such that said antenna element top cap propagates water meter data to a remote data collection unit.

3. An apparatus as in claim 1, wherein said antenna element top cap and said depending base thereof are integrally formed.

4. An apparatus as in claim 1, wherein said RF transmitter is a battery operated radio transmitter supported within the associated pit box.

5. An apparatus as in claim 1, wherein said antenna element top cap is exposed to the environment outside of the underground pit box.

6. An apparatus as in claim 1, wherein said antenna element top cap and said depending base thereof comprise a metallic substance.

7. An apparatus as in claim 6, wherein said metallic substance comprises copper.

8. An apparatus as in claim 1, wherein said utility meter interconnection means comprise shielded wiring connected between the utility meter within the underground pit box and said RF transmitter.

9. An apparatus as in claim 8, wherein:

said utility meter interconnection means are interconnected with a water meter within the underground pit box such that said antenna element top cap propagates water meter data to a remote data collection unit;

said antenna element top cap and said depending base thereof comprise copper; and wherein said RF transmitter is a battery operated radio transmitter supported within the associated pit box.

10. An apparatus as in claim 1, wherein said antenna element depending base is exposed to the environment inside of the underground pit box.

11. An apparatus as in claim 10, wherein said antenna element top cap is exposed to the environment outside of the underground pit box.

12. An arrangement for obtaining data from a water meter received in an underground pit box of the type having a lid with a predetermined opening therethrough, said arrangement comprising:

transmitter means received within such a pit box and interconnected with a water meter received therein for transmitting water meter data therefrom; and antenna means, associated with said transmitter means, and extending at least partly through such pit lid predetermined opening so as to be at least partly exposed to its surrounding environment, so that water meter data transmitted by said transmitter means are propagated by said antenna means from a portion thereof outside such pit box.

13. An arrangement as in claim 12, wherein said antenna means includes an upper generally circular member passed through and exposed above the predetermined opening of the pit box lid, and further includes a lower generally straight member depending downwardly from said upper member so as to extend and pass through the pit box lid opening down into the pit box.

14. An arrangement as in claim 13, further wherein said antenna means lower generally straight member is exposed within the pit box.

15. An arrangement as in claim 13, wherein said antenna means upper and lower members are integrally formed.

16. An arrangement as in claim 13, wherein said transmitter means includes a battery operated transmitter and a battery therefor received within a transmitter housing supported within the pit box.

17. An arrangement as in claim 13, wherein said antenna means comprise a metallic substance.

18. An arrangement as in claim 17, wherein said metallic substance comprises copper.

19. An arrangement as in claim 12, wherein:

said transmitter means include a transmitter housing with a transmitter received thereinside.

20. An arrangement as in claim 19, wherein said transmitter is battery operated and wherein a battery therefor is received inside said transmitter housing.

* * * * *

UNITED STATES PATENT AND TRADEMARK OFFICE

CERTIFICATE OF CORRECTION

PATENT NO. : 6,177,883 B1 
DATED : January 23, 2001
INVENTOR(S) : Anthony G. Jennetti et al.

It is certified that error appears in the above-identified patent and that said Letters Patent is hereby corrected as shown below:

Title page,
Item [56], References Cited, insert the following:
-- 5,621,419 4/1997 Meek, et al. ……
5,298,894 3/1994 Cerny, et al. …… --

Signed and Sealed this

Third Day of December, 2002

JAMES E. ROGAN
*Director of the United States Patent and Trademark Office*